US012503266B2

(12) United States Patent
Patel

(10) Patent No.: US 12,503,266 B2
(45) Date of Patent: Dec. 23, 2025

(54) STRAPPING DEVICE CONFIGURED TO DYNAMICALLY ADJUST A TENSION PARAMETER

(71) Applicant: Signode Industrial Group LLC, Tampa, FL (US)

(72) Inventor: Joel Patel, Hawthorn Woods, IL (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 343 days.

(21) Appl. No.: 18/480,758

(22) Filed: Oct. 4, 2023

(65) Prior Publication Data

US 2024/0124176 A1 Apr. 18, 2024

Related U.S. Application Data

(60) Provisional application No. 63/379,960, filed on Oct. 18, 2022.

(51) Int. Cl.

| | |
|---|---|
| ***B65B 57/02*** | (2006.01) |
| ***B65B 13/04*** | (2006.01) |
| ***B65B 13/22*** | (2006.01) |

(52) U.S. Cl.

CPC ..... *B65B 57/02* (2013.01); *B65B 13/04* (2013.01); *B65B 13/22* (2013.01); *B65B 2210/14* (2013.01)

(58) Field of Classification Search

CPC ..... B65B 57/02; B65B 13/04; B65B 2210/14; B65B 27/12; B65B 13/02; B65B 13/22

See application file for complete search history.

(56) References Cited

U.S. PATENT DOCUMENTS

| | | | | |
|---|---|---|---|---|
| 3,439,606 | A | 4/1969 | Bursik et al. | |
| 3,494,280 | A | 2/1970 | Kobiella | |
| 3,536,430 | A | 10/1970 | Kurihara | |
| 3,586,572 | A | 6/1971 | Ericsson | |
| 3,674,972 | A | 7/1972 | Stahnke | |
| 3,720,158 | A | 3/1973 | Sauer et al. | |
| 3,759,169 | A | 9/1973 | Goodley | |
| 3,851,576 | A | 12/1974 | Takahashi | |
| 4,177,724 | A * | 12/1979 | Johnson, III | B65B 13/22 100/32 |
| 4,314,131 | A | 2/1982 | Fryer | |

(Continued)

FOREIGN PATENT DOCUMENTS

| | | | |
|---|---|---|---|
| CA | 1318365 C | 5/1993 | |
| DE | 202004016951 U1 * | 1/2005 | B65B 13/22 |

(Continued)

OTHER PUBLICATIONS

"Pictures of Tension Check", available before the priority date of this patent application.

"Strap Tension Meters For Packaging Quality Management", Altic Coil, located at: https://altic-coil-winding.com/product-range/strap-tension-meters-for-packaging/, available before the priority date of this patent application.

(Continued)

*Primary Examiner* — Jimmy T Nguyen

(74) *Attorney, Agent, or Firm* — Neal, Gerber & Eisenberg LLP

(57) ABSTRACT

Various embodiments of the present disclosure provide a strapping device with a force-measurement system, that, responsive to determining that a strap on a load is under tensioned causes subsequent tensioning of straps to be increased, and responsive to determining that a strap on a load is over tensioned causes subsequent tensioning of straps to be decreased.

20 Claims, 9 Drawing Sheets

(56) References Cited

U.S. PATENT DOCUMENTS

| | | | | |
|---|---|---|---|---|
| 4,683,017 | A | 7/1987 | Figiel et al. | |
| 4,836,873 | A | 6/1989 | Mitanihara et al. | |
| 4,850,179 | A | 7/1989 | Takami | |
| 5,146,847 | A | 9/1992 | Lyon et al. | |
| 5,722,214 | A | 3/1998 | Spatafora | |
| 5,791,238 | A * | 8/1998 | Garbotz | B65B 13/22 100/32 |
| 5,894,789 | A | 4/1999 | Huber | |
| 6,038,967 | A | 3/2000 | Chak et al. | |
| 6,560,947 | B2 | 5/2003 | Kasel | |
| 6,571,531 | B2 | 6/2003 | Kasel | |
| 6,668,516 | B2 | 12/2003 | Sakaki et al. | |
| 6,899,505 | B2 | 5/2005 | Hataya | |
| 6,928,787 | B2 | 8/2005 | Shibazaki et al. | |
| 8,701,555 | B2 | 4/2014 | Bell | |
| 9,061,779 | B2 | 6/2015 | Elliott et al. | |
| 11,021,282 | B2 | 6/2021 | Elliott | |
| 11,577,867 | B2 | 2/2023 | Elliott | |
| 11,643,232 | B2 | 5/2023 | Mårstedt et al. | |
| 2008/0044713 | A1 | 2/2008 | Fritz et al. | |
| 2012/0098189 | A1 | 4/2012 | Meersoek | |
| 2012/0286739 | A1 | 11/2012 | Obrien et al. | |

FOREIGN PATENT DOCUMENTS

| | | | |
|---|---|---|---|
| EP | 1394041 | A1 | 3/2004 |
| EP | 1914166 | B1 | 10/2012 |
| EP | 2285692 | B1 | 12/2013 |
| EP | 2803590 | A1 | 11/2014 |
| EP | 2711301 | B1 | 11/2016 |
| EP | 2803588 | B1 | 11/2016 |
| EP | 2803589 | B1 | 11/2016 |
| EP | 3006351 | B1 | 1/2019 |
| EP | 3760549 | A1 | 1/2021 |
| JP | 444922 | A | 2/1992 |
| JP | 2003072708 | A | 3/2003 |
| KR | 102277737 | B1 | 7/2021 |
| TW | 200415074 | A | 8/2004 |
| TW | 201636268 | A | 10/2016 |
| WO | 2015193136 | A1 | 12/2015 |
| WO | 2022238968 | A1 | 11/2022 |

OTHER PUBLICATIONS

"Extended European Search Report", from related European Patent Application No. 23204269.7, May 10, 2024.

* cited by examiner

STRAPPING DEVICE CONFIGURED TO DYNAMICALLY ADJUST A TENSION PARAMETER

PRIORITY

This application claims priority to and the benefit of U.S. Provisional Patent Application No. 63/379,960, filed Oct. 18, 2022, the entire contents of which is incorporated herein by reference.

FIELD

The present disclosure relates to strapping devices configured to carry out a strapping process to form a strap loop around a load, and more particularly to strapping devices configured to dynamically adjust a tension parameter used to tension the strap for later strapping processes.

BACKGROUND

A strapping device carries out a strapping process to form a loop of plastic strap (such as polyester or polypropylene strap), paper strap, or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components. To strap the load, the strapping head carries out a feed cycle by controlling a feed module of the strapping head to feed strap (leading strap end first) from a strap supply into and through the strap chute (along the strap path) until the leading strap end reaches a sealing module of the strapping head. While the sealing module holds the leading strap end, the strapping head carries out a retract cycle by controlling the feed module to retract the strap to pull the strap out of the strap chute and onto the load. The strapping head then carries out a tensioning cycle by controlling a tension module of the strapping head to tension the strap. The strapping head then carries out a sealing cycle by controlling the sealing module to attach two overlapping portions of the strap to one another to form a strap joint and cut the strap from the strap supply to complete formation of the strap loop around the load.

To ensure the load is properly secured and the strap joint is not in danger of failing, during the tensioning cycle the strapping head attempts to tension the strap to a tension level within a designated tension range. Over time and with wear to the components of the tension module, the tension module may unintentionally tension the strap to a tension level above or below the designated tension range, resulting in over-tensioned or under-tensioned strap loops. Over-tensioned strap loops exert a greater force on the strap joint and thus have a higher likelihood of failure than optimally tensioned strap loops. This extra tension can also damage the load. Under-tensioned strap loops are looser than optimally tensioned strap loops, resulting in a load that isn't properly secured.

Currently, under- or over-tensioned strap loops are often not detected. And if they're detected at all, it's only because the strap joints have already broken or the load is visibly unsecured, either resulting in a damaged load or requiring the load to be re-strapped. Even if an operator happens to recognize that the strapping device is forming under- or over-tensioned strap loops, the operator must use trial-and-error to try to dial in the proper adjustments to the strapping head to get back to the optimal strap tension.

SUMMARY

Various embodiments of the present disclosure provide a strapping device including a strapping head configured to carry out a strapping process to form a loop of strap around a load. The strapping cycle includes a tensioning cycle during which the strapping head is configured to tension the strap at least in part based on a tension parameter. The strapping device includes a force sensor configured to detect an amount of force. The strapping device includes a controller configured to control the strapping head to carry out the strapping process to form the loop of strap around the load. After forming the loop of strap around the load, the controller receives, from the force sensor, force data representing an amount of tension in the loop of strap around the load. The controller determines, based on the force data, whether a tension-adjustment condition is met. Responsive to determining that the tension-adjustment condition is met, the controller adjust the tension parameter for a later tensioning cycle.

DETAILED DESCRIPTION

Figure 1:
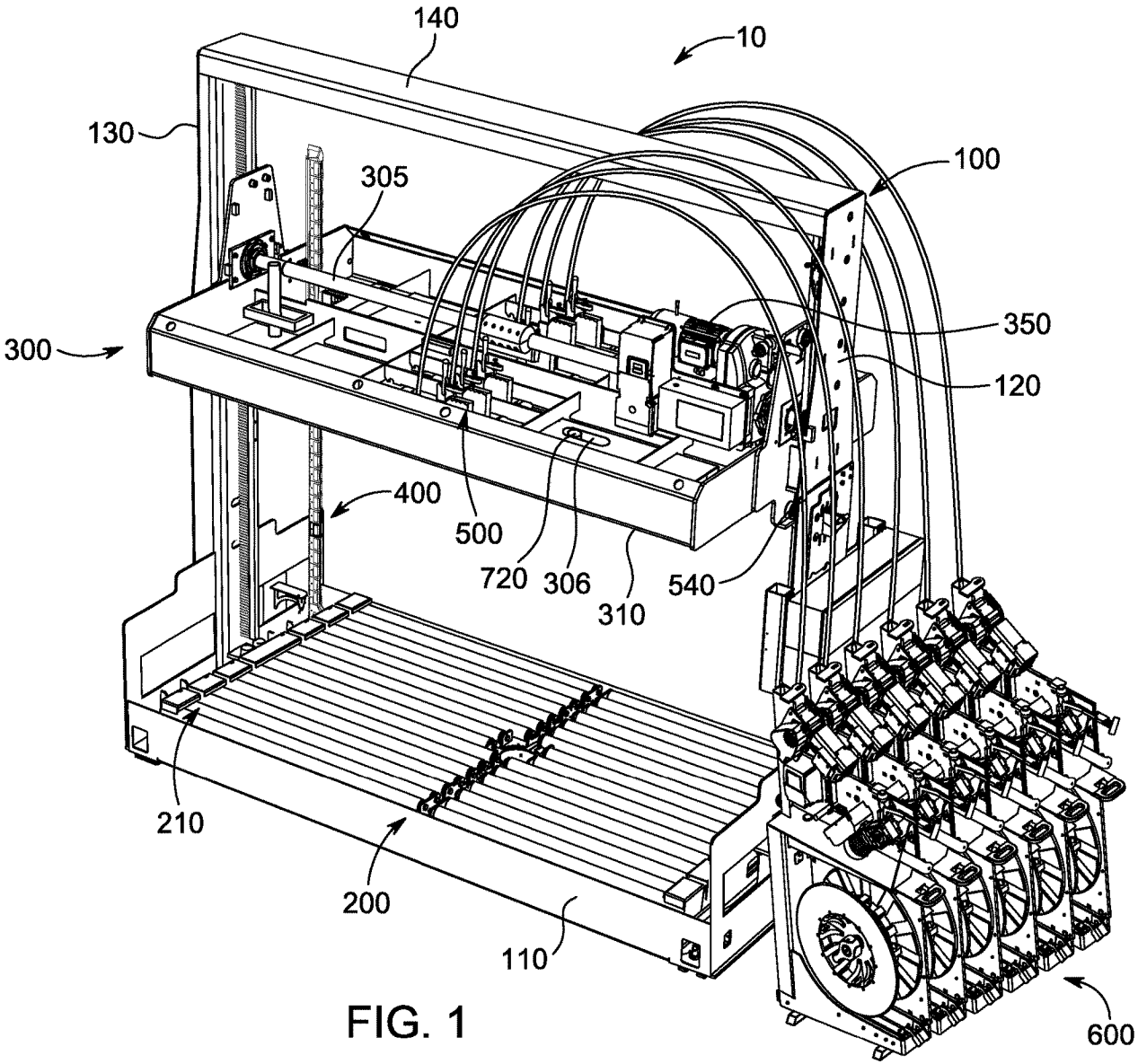
FIG. 1 is a perspective view of one example embodiment of a press-type strapping device of the present disclosure.

While the systems, devices, and methods described herein may be embodied in various forms, the drawings show, and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

The strapping device of the present disclosure can be any one of a plurality of different types of strapping devices, such as (but not limited to) press-type strapping devices, tabletop strapping devices, arch strapping devices, pallet strapping devices, and handheld strapping devices. A press-type strapping device is used as an example herein to explain the present disclosure; however, the present disclosure is not limited to such press-type strapping devices.

FIGS. 1-7 show one example embodiment of the press-type strapping device 10 of the present disclosure (referred to as the "strapping device" below for brevity) and components thereof. The strapping device 10 is configured to apply a compressive force to a load (such as a load L of a stack of flattened corrugated sheets) to compress the load before carrying out strapping processes to form multiple strap loops around the load (such as strap loops S) using multiple strapping heads. The strapping device 10 is configured to determine measure a force related to the tension in the strap loops and determine whether a tension-adjustment condition is met based on that measured force. If so, the strapping device 10 is configured to automatically and without operator input change a tension parameter for subsequent strapping processes.

The strapping device 10 includes a device frame 100, a load supporter 200, a platen 300, a platen actuator 350, multiple strap chutes 400 (only one of which is shown and labeled for clarity), multiple strapping heads 500 (only one of which is labeled for clarity) each configured to draw strap from a respective strap supply 600 (only one of which is labeled for clarity), a force-measurement system 700, and a controller 800.

Figure 2:
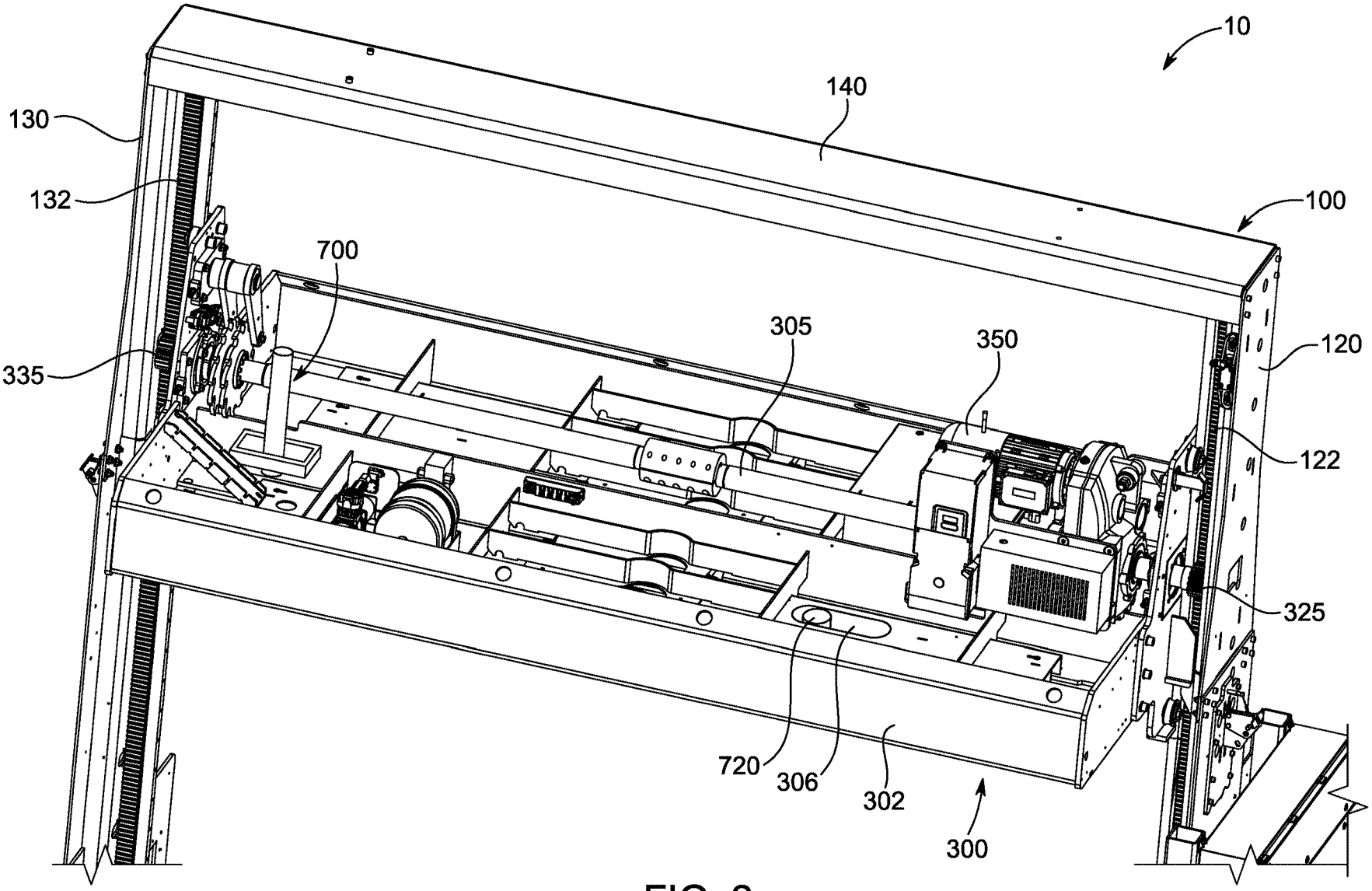
FIG. 2 is a perspective view of the platen and part of the strap engager of the force-measurement system of the strapping device of FIG. 1.

The device frame 100, which is best shown in FIGS. 1 and 2, is configured to support some (or in certain embodiments all) of the other components of the strapping device 10. In this example embodiment, the device frame 100 includes a base 110, first and second spaced-apart upstanding legs 120 and 130, and connector 140 that spans and connects the upper ends of the first and second legs 120 and 130. The first and second legs 120 and 130 include respective vertically extending toothed racks 122 and 132 that enable the platen 300 to move relative to the first and second legs 120 and 130 in a rack-and-pinion fashion. This is merely one example of a configuration of components that form the device frame 100, and any other suitable configuration of any other suitable components can form the device frame 100 in other embodiments.

The load supporter 200, which is best shown in FIG. 1, is configured to support and move loads (such as the load L) through the strapping device 10. The load supporter 200 includes a load-supporter frame and a conveyor actuator (not shown). The conveyor 210 is mounted to the load-supporter frame and is configured to support loads during compression and strapping and to move loads through the strapping device 10. In this example embodiment, the conveyor 210 includes first and second sets of aligned rollers (not labeled). The conveyor actuator is operably connected to the rollers—such as via gearing, chains, belts, and the like—to drive the rollers. The conveyor actuator can be any suitable actuator, such as an electric, pneumatic, or hydraulic motor. The load supporter 200 is mounted to the base 110 of the device frame 100 between the first and second legs 120 and 130 and below the connector 140.

The platen 300 is configured to apply a compressive force to the loads to compress them before strapping. The platen 300 includes a platen frame 302 that supports the platen actuator 350. The platen frame 302 is movably mounted to the first and second legs 120 and 130 of the device frame 100 above the load supporter 200 and is vertically movable relative to the load supporter 200 so the platen 300 can adjust to loads of different heights and apply a compressive force to the loads. More specifically, the platen 300 includes a drive shaft 305 rotatably supported by the platen frame 302 (such as via bearings). A first pinion 325 is fixed to one end of the drive shaft 305, and a second pinion 335 is fixed to the other end of the drive shaft 305. The pinions 325 and 335 are fixed to the drive shaft 305 via a splined connection, a keyed connection, a coupler, or in any other suitable manner so the drive shaft 305 and the pinions 325 and 335 rotate together. The drive shaft 305 extends between the first and second legs 120 and 130 of the device frame 100 such that the first pinion 325 meshes with the toothed rack 122 of the first leg 120 and the second pinion 335 meshes with the toothed rack 132 of the second leg 130.

In this example embodiment, the platen actuator 350 is operably connected to the drive shaft 305 (and therefore the pinions 325 and 335) via gearing (not shown) such that rotation of an output shaft (not shown) of the platen actuator 350 results in rotation of the drive shaft 305 and the pinions 325 and 335. This rotation of the pinions 325 and 335 (which rotate together via their fixed connection to the drive shaft 305) causes the pinions to climb or descend their respective toothed racks 122 and 132 such that the platen 300 moves away from or toward the conveyor 210 of the load supporter 200 (i.e., ascends or descends). Specifically, rotating the output shaft of the platen actuator 350 in a first rotational direction results in rotation of the drive shaft 305 (and the pinions 325 and 335) in a raising rotational direction and movement of the platen 300 away from the conveyor 210. Conversely, rotating the output shaft of the platen actuator in a second rotational direction opposite the first rotational direction results in rotation of the drive shaft 305 (and the pinions 325 and 335) in a lowering rotational direction and movement of the platen 300 toward the conveyor 210. The platen actuator 350 is controlled by the controller 800 and includes any suitable actuator, such as an electric, pneumatic, or hydraulic motor, operably connected to the platen 300 to move the platen 300 relative to the first and second legs 120 and 130 toward and away from the conveyor 210 of the load supporter 200 (i.e., downward, and upward). This is merely one example embodiment of the platen actuator, and any suitable actuator can be employed. Additionally, any other suitable manner of controlling vertical movement of the platen 300 can be employed (e.g., hydraulic, or pneumatic cylinders, belt-and-pulley assemblies, and the like), as the rack-and-pinion configuration is merely one example embodiment.

Each strap chute 400 circumscribes the conveyor 210 and defines a strap path that the strap follows when fed through the strap chute 400 and from which the strap is removed when retracted. The strap chute 400 includes two spaced-apart first and second upstanding legs (not labeled), an upper connecting portion (not shown) that spans the first and second legs and is positioned in the platen 300, a lower connecting portion (not shown) that spans the first and second legs and is positioned in the load supporter 200, and elbows that connect these portions. The radially inward wall of the strap chute 400 is formed from multiple gates that are spring biased to a closed position that enables the strap to traverse the strap path when fed through the strap chute 400. When the strapping head 500 later exerts a pulling force on the strap to retract the strap, the pulling force overcomes the biasing force of the springs and causes the gates to pivot to an open position, thereby releasing the strap from the strap chute so the strap contacts the load as the strapping head 500 continues to retract the strap.

Each strapping head 500 is configured to form a strap loop around the load by feeding the strap through the strap chute 400 along the strap path, holding the leading strap end while retracting the strap to remove it from the strap chute 400 so it contacts the load, tensioning the strap around the load, connecting two overlapping portions of the strap to one another, and cutting the strap from the strap supply. In this example embodiment, the strapping head 500 is a modular strapping head including independently removable and replaceable feed, tensioning, and sealing modules. The feed module (not labeled), which is configured to feed and retract the strap, and the tensioning module, which is configured to tension the strap, are mounted to a frame (not labeled) of the strap supply 600. That is, in this example embodiment, the feed module and the tensioning module are located remote from the device frame 100 (though in other embodiments the feed module and/or tensioning module can be supported by the device frame 100, the platen 300, or any other suitable component of the strapping device 10). The platen 300 supports the sealing module (not labeled), which is configured to hold the leading strap end, cut the strap from the strap supply, and connect via welding the leading strap end and trailing strap end to one another. A strap guide 540 extends between the feed module and the tensioning module and the sealing module and is configured to guide the strap as it moves between the modules. This is merely one example strapping head, and the strapping device can include any suitable modular strapping head or non-modular strapping head. The manner of attaching the leading and trailing strap ends to one another depends on the type of strapping device and the type of strap. Certain strapping devices configured for plastic strap include strapping heads with sealing modules that include friction welders, heated blades, or ultrasonic welders configured to attach the leading and trailing strap ends to one another.

During the tensioning cycle of the strapping process, the tensioning module tensions the strap by driving a tensioning roller with a tensioning motor to pull tension in the strap until the tensioning motor stalls. The tensioning motor stalls when the current drawn by the tensioning motor reaches a preset percentage of the maximum current draw of the tensioning motor. The preset percentage of the maximum current draw of the tensioning motor is a tension parameter that the operator (or the device) can set to control the tension in the strap loop after tensioning. The higher the preset percentage of the maximum current draw, the higher the tension in the strap loop, and the lower the preset percentage of the maximum current draw, the lower the tension in the strap loop. For instance, a preset percentage of the maximum current draw of 30% may be correlated with a tension of 50 pounds, whereas a preset percentage of the maximum current draw of 90% may be correlated with a tension of 110 pounds. The particular preset percentage of the maximum current draw selected for a particular application will vary based on the type of strap, the dimensions of the strap, and the type of load.

The force-measurement system 700, which is shown in FIGS. 3-7, is configured to measure a force related to the tension in the strap loop after the strapping head 500 has formed the strap loop around a load. The force-measurement system 700 is supported by the platen 310 and includes a strap engager 710, a strap-engager actuator 740, and a force sensor 770.

The strap engager 710 includes a vertically extending support 720 and an arm 730 connected to and laterally extending from the support 720. The arm 730 includes a strap-engaging finger 732. The support 720 extends through a vertically and laterally extending slot 306 defined by an interior wall 308 of the frame 302 of the platen 310. The strap engager 710 is movable in the slot 306 between a strapping position (shown in FIGS. 4A, 5A, and 5B) and a measurement position (shown in FIGS. 4B and 6). The strap engager 710 is also rotatable about the (vertical) longitudinal axis of the support 720 between a strap-release position (shown in FIG. 7) and a strap-engagement position (shown in FIGS. 5A and 5B).

Figure 3:
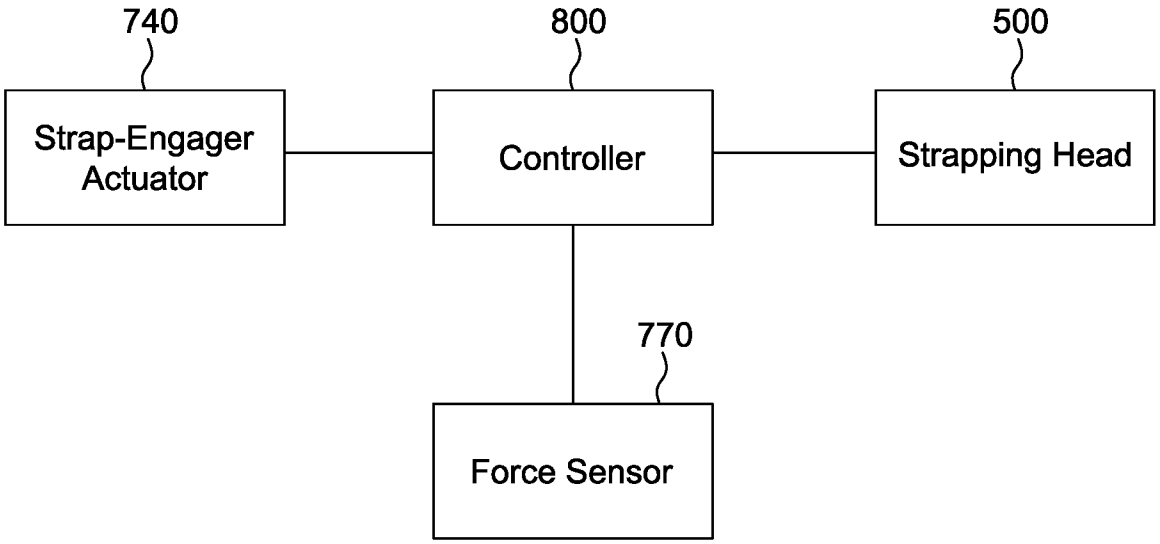
FIG. 3 is a block diagram showing certain components of the strapping device of FIG. 1.
Figure 4A:
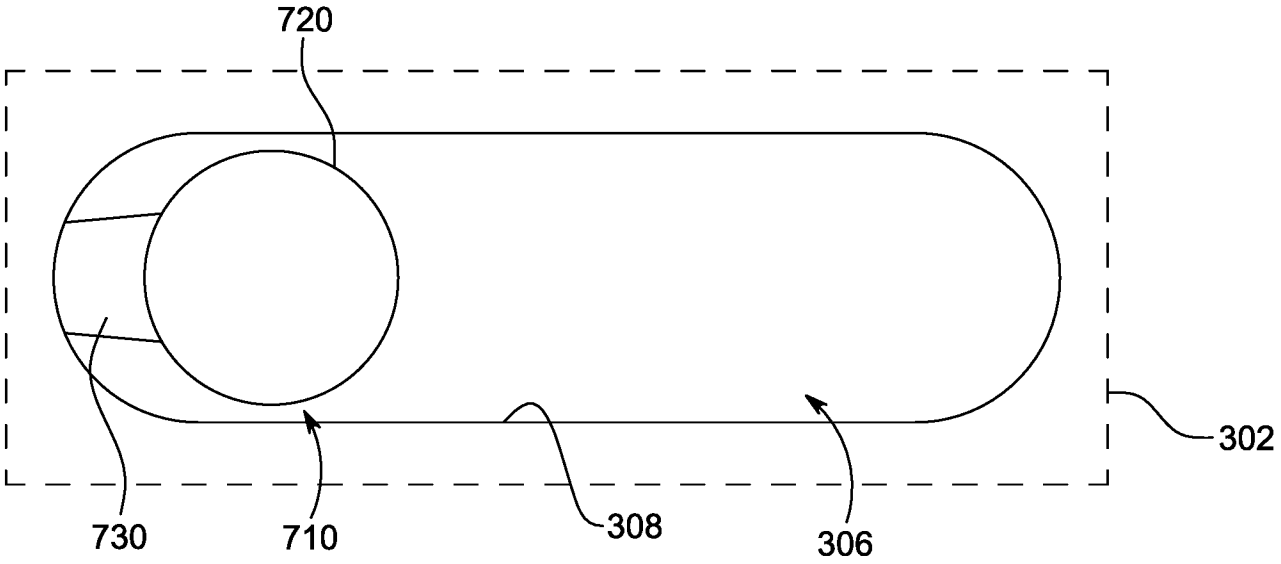
FIG. 4A is a top plan view of part of the platen and part of the strap engager of the force-measurement system of the strapping device of FIG. 1 showing the shaft of the strap engager in a strapping position.
Figure 4B:
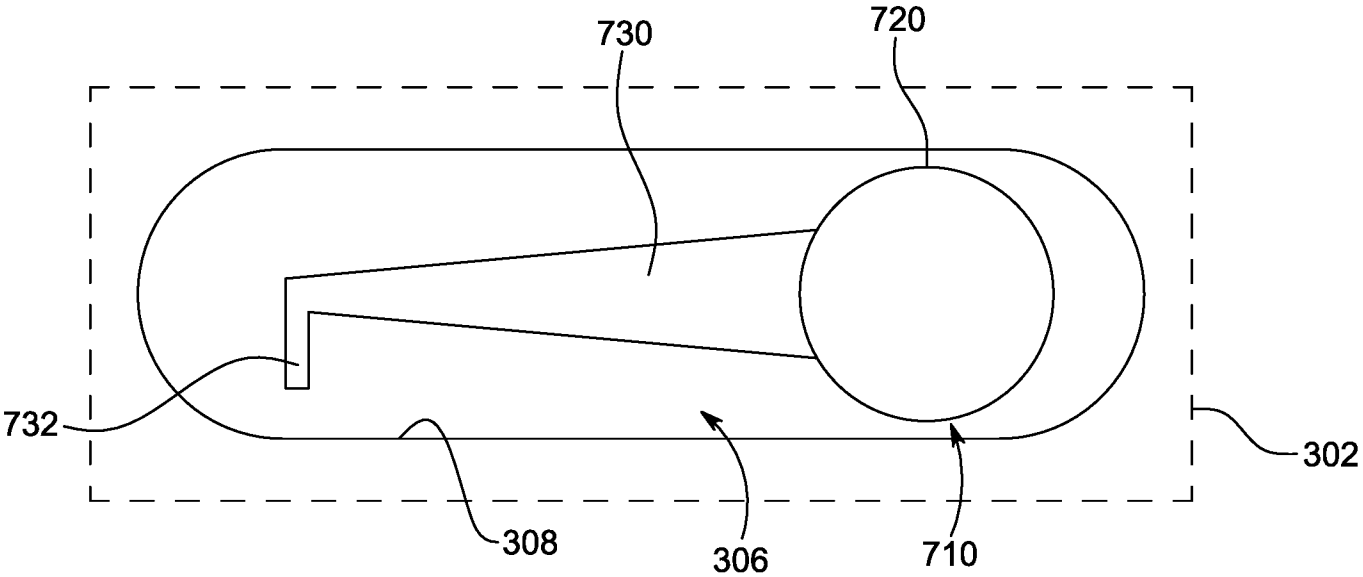
FIG. 4B corresponds to FIG. 4A but shows the shaft of the strap engager in a measurement position.

The strap-engager actuator 740 (FIG. 3) is operably connected to the strap engager 710 and configured to both move the strap engager 710 between the strapping and measurement positions and to rotate the strap engager 710 between the strap-engagement and strap-release positions. The strap-engager actuator 740 can include any suitable actuator or actuators and can be suitably mounted to the platen 310. The strap-engager actuator 740 can be operably connected to the strap engager 710 in any suitable manner. In this example embodiment (as shown in FIG. 3), the controller 800 is operably connected to the strap-engager actuator 740 and configured to control this actuator 740. In various embodiments, the strap-engager actuator 740 includes multiple actuators, and particularly a first actuator that moves the strap engager between the strapping and measurement positions and a second actuator that rotates the strap engager between the strap-engagement and strap-release positions. In certain embodiments, the strapping device includes a biasing element (such as a spring) that biases the strap engager to its strap-engagement or its strap-release position. In various embodiments, the strapping device includes a biasing element (such as a spring) that biases the strap engager to its strapping position or its measurement position.

The force sensor 770 includes a suitable sensor configured to detect a force exerted on a component of the force-measurement system 700. In this embodiment, the force sensor 770 includes a strain gauge load cell configured to convert a force exerted on the finger 732 into an electrical signal that can be measured and standardized. For instance, the force sensor 770 is configured to detect the force exerted by the strap loop on the finger 732 as the strap engager 710 moves from the strapping position to the measurement position, as described below. In another embodiment, the force sensor is configured to detect the torque exerted on the motor of the strap-engager actuator 740 during this same movement. The force sensor 770 is configured to generate force data representative of the detected amount of force and to send the force data to the controller 800, such as via a wired or wireless connection.

The controller 800 includes a processing device (or devices) communicatively connected to a memory device (or devices). For instance, the controller can be a programmable logic controller. The processing device can include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device can include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping device 10. The controller 800 is communicatively and operably connected to the conveyor actuator, the platen actuator 350, the strapping head 500, and the force-measurement system 700 (as described below) to receive signals from and to control those components.

The controller 800 is configured to receive the force data from the force sensor and determine whether a tension-adjustment condition is met based on the force data. If the tension-adjustment condition is met, the controller 800 is configured to adjust a tension parameter for one or more later strapping processes. In this example embodiment, the controller 800 uses the force data to determine whether the tension in the strap is within a designated tension range. If the controller 800 determines that the tension in the strap is within the designated tension range, the controller 800 does not modify the tension parameter for any later strapping processes. If the controller 800 determines that the strap is under-tensioned—i.e., that the tension in the strap is below the designated tension range—the controller 800 adjusts the tension parameter (such as by increasing the preset percentage of the maximum current value) such that the tensioning module pulls more tension in the strap for the next strapping process. If the controller 800 determines that the strap is over-tensioned—i.e., that the tension in the strap is above the designated tension range—the controller 800 adjusts the tension parameter (such as by decreasing the preset percentage of the maximum current value) such that the tensioning module pulls less tension in the strap for the next strapping process.

In various embodiments, the controller can make the adjustments in predetermined increments until the tension in a strap loop is within the designated tension range.

In various embodiments, the controller makes the adjustments to the strap tension parameter of the tensioning module based on the type and dimensions of the strap.

In various embodiments, the tension can be adjusted by changing the current limit on the take-up motor of the strapping head. The tension level can be adjusted in minor increments until the optimal level is achieved and stored as an offset in the controller 800. In one example, if the set tension level is set to 50% of maximum tension where the maximum tension is 120 lbs, and if the measured value is 70 lbs, the controller 800 can make a correction to lower the level by 5% at a time until the optimal level is achieved. The final correction can be stored in the controller 800.

In various different embodiments, the analysis of the tension of the straps on the loads strapped by the strapping device 10 can be performed by the strapping device 10 for: (1) one of the straps on each strapped load; (2) two or more of the straps on each strapped load (by different strapping heads); (3) each strap on each strapped load; (4) one or more straps on randomly selected strapped loads; or (5) one or more straps on strapped loads according to a predetermined schedule (such as every fifth tenth load). Additionally, after an adjustment, the analysis of the tension of the straps on the loads can be performed by the strapping device 10 for one or more straps on a predetermined quantity of strapped loads (such as for the next five strapped loads) after an adjustment is made to determine if the adjustment caused the tension to be within the optimal tension range for such subsequent straps and to make any further adjustments.

Operation of the strapping device 10 to conduct a strapping process to strap a load and a force measurement of that strap is now described.

To start the process, the load L is moved to a first strapping area atop the conveyor 210 and beneath the platen 300. The controller 800 controls the platen actuator 350 to move the platen 300 toward the conveyor 210 and into contact with the load L. As the platen 300 moves downward, it applies a compressive force to the load L and compresses the load L.

Figure 5A:
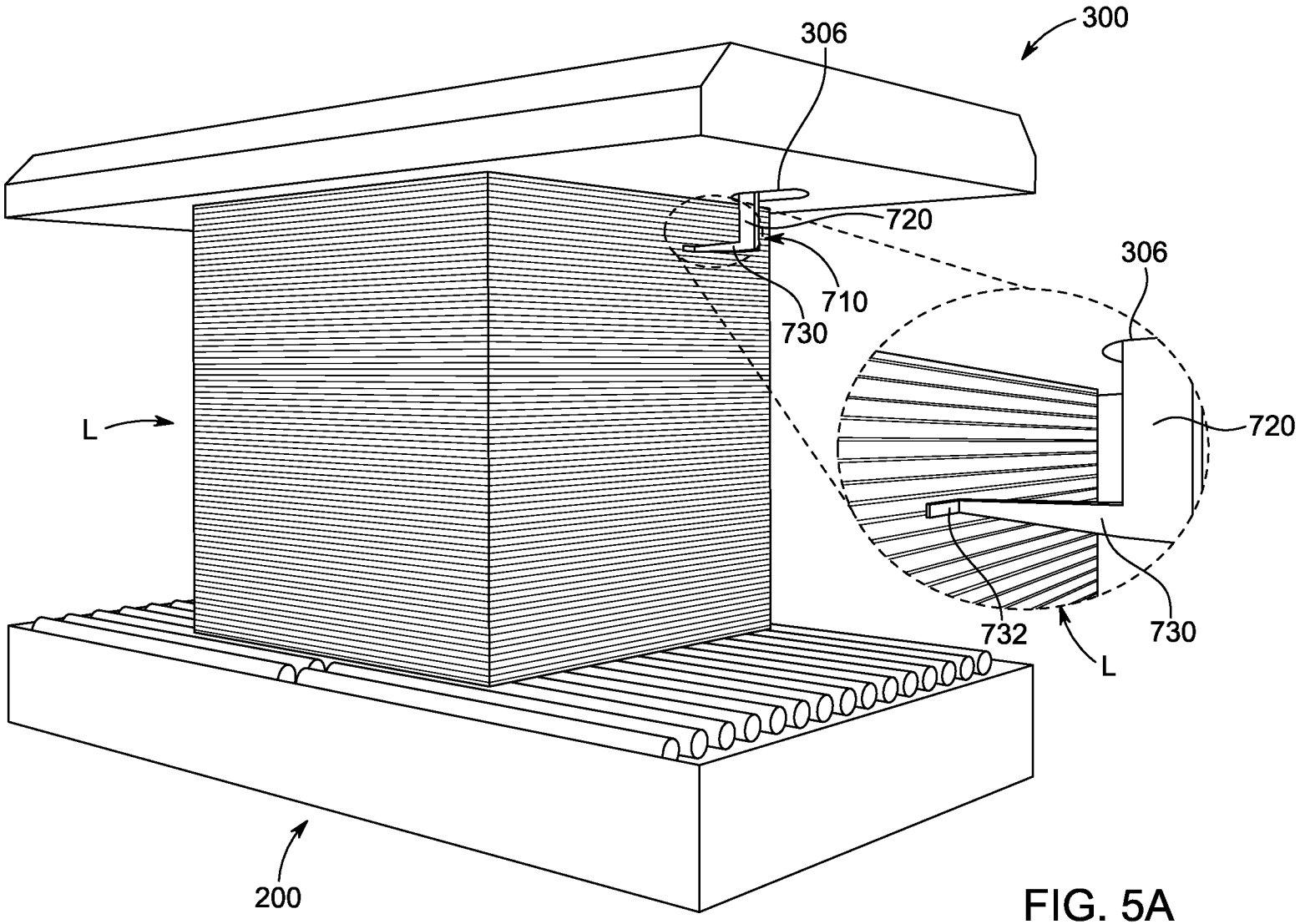
FIG. 5A is a diagrammatic perspective view of the strapping device of FIG. 1 showing the strap engager of the force-measurement system in the strapping position before the strap is applied to the load.
Figure 5B:
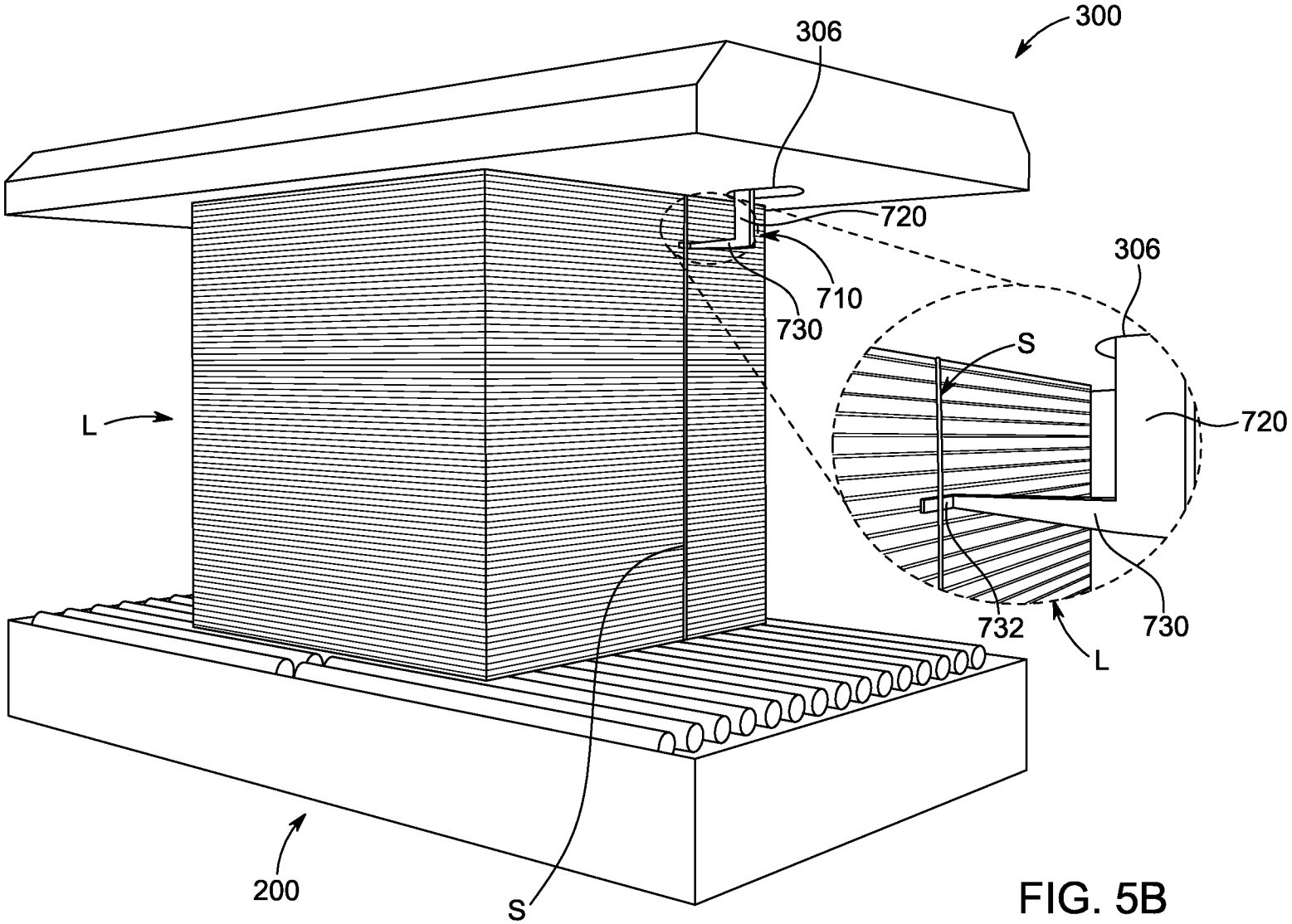
FIG. 5B is a diagrammatic perspective view of the strapping device of FIG. 1 showing the strap engager of the force-measurement system in the strapping position and engaged by a strap on a load after the load has been strapped.
Figure 6:
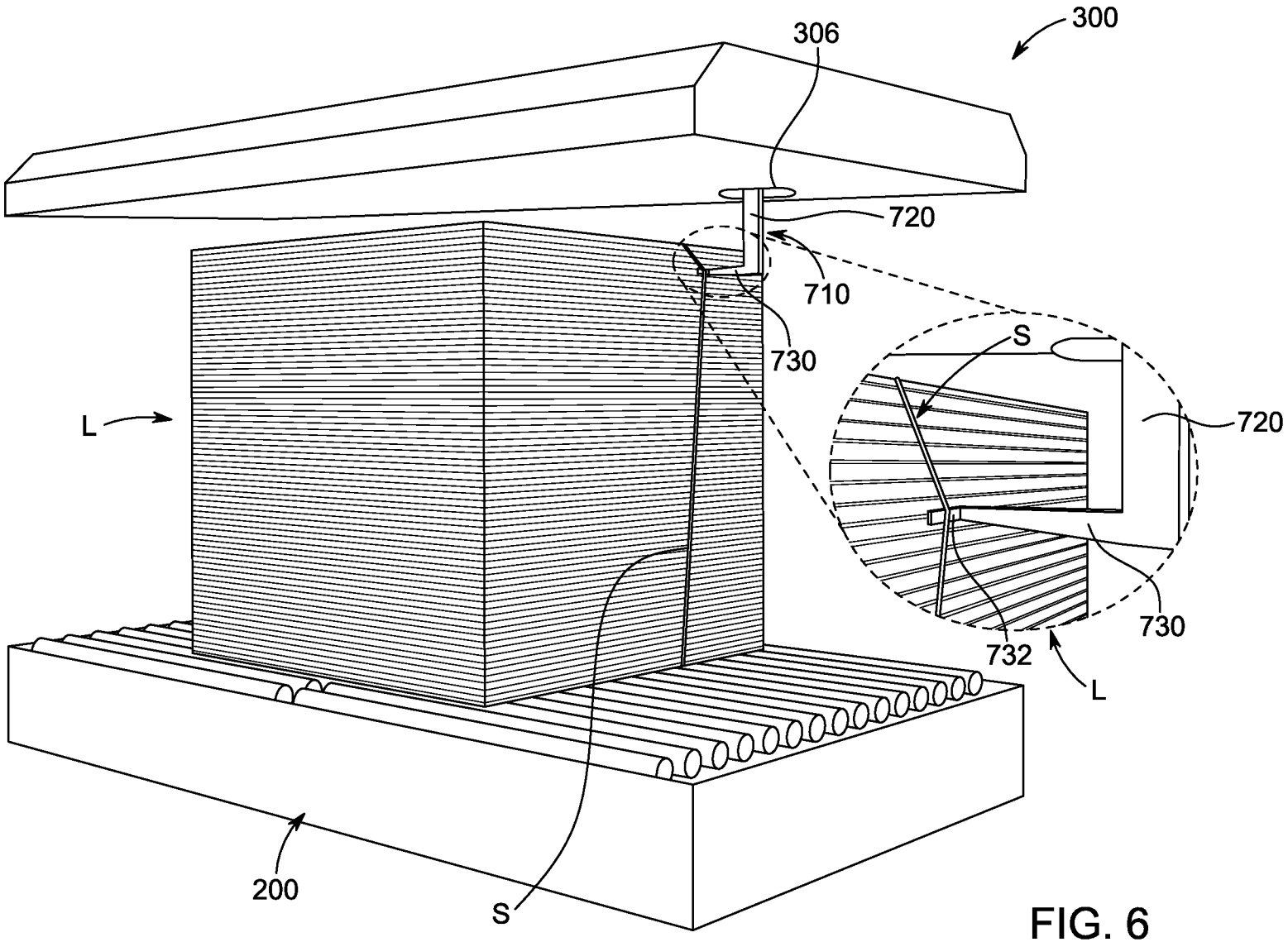
FIG. 6 is a diagrammatic perspective view of the strapping device of FIG. 1 showing the strap engager of the force-measurement system in the measurement position and applying a force to the strap on the load.
Figure 7:
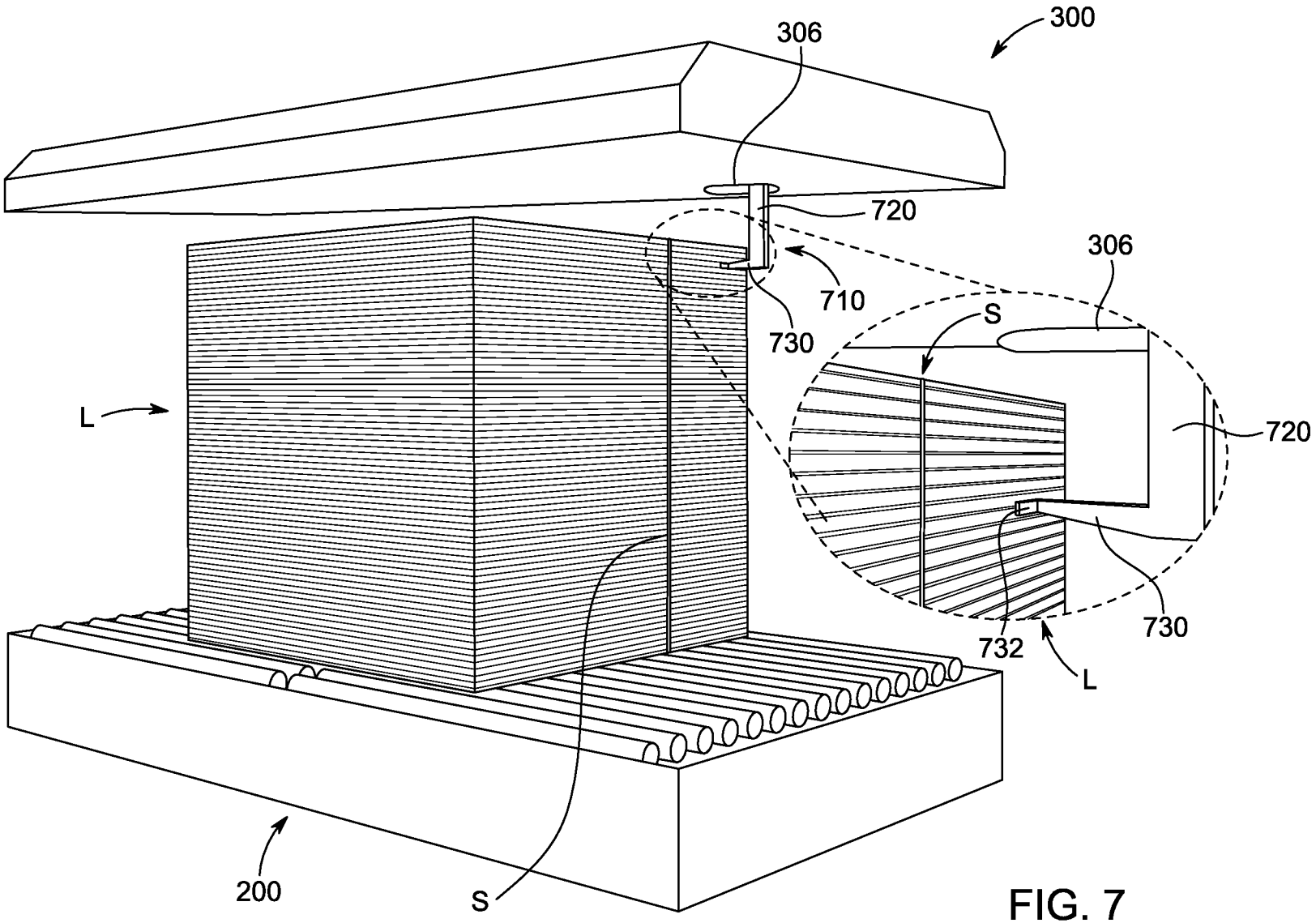
FIG. 7 is a diagrammatic perspective view of the strapping device of FIG. 1 showing the strap engager of the force-measurement system after the strap engager has released the strap.

Prior to a strap being applied to the load L, the controller 800 controls the strap-engager actuator 740 to move the strap engager 710 to the strapping position and the strap-engagement position (FIGS. 4A and 5A) such that the finger 732 of the strap engager 710 is adjacent to (which can include in contact with) the load L. The controller 800 then controls the strapping head(s) 500 to strap the load L to form strap loop S as shown in FIG. 5B. The controller 800 then controls the platen actuator 350 to move the platen 300 away from the conveyor 210 so the platen 300 disengages the load L as shown in FIG. 6. This allows the load L to decompress and expand upward. The controller 800 then controls the strap-engager actuator 740 to move the strap engager 710 from the strapping position shown in FIG. 5B to the measurement position shown in FIG. 6, thereby causing the finger 732 to pull the strap loop S a predetermined distance away from the load L as shown in FIG. 6. The force sensor detects the amount of force the strap loop S applies to the finger 732 while the strap engager 710 is in the measurement position. The force sensor 770 converts this amount of force into force data and sends a signal representing the force data to the controller 800. The controller 800 controls the strap-engager actuator 740 to rotate the strap engager 710 to the strap-release position such that the finger 732 of the strap engager 710 releases the strap S, which snaps back onto the load L as shown in FIG. 7.

The controller 800 determines an amount of tension of the strap loop S using the force data and an appropriate conversion algorithm or other method. The controller 800 determines whether the tension in the strap loop S is within a designated tension range (appropriate for the particular application and type and size of strap). The controller 800, responsive to the tension of the strap loop S being not being within the predetermined tension range, automatically adjusts a tensioning parameter of the tensioning module for one or more subsequent strapping processes to either increase or decrease the tension pulled by the tensioning module. More specifically, the controller 800, responsive to the strap loop S being under tensioned (i.e., the amount of tension in the strap loop being below the designated tension range), adjusts the tensioning parameter of the tensioning module to increase the tension pulled by the tensioning module for the subsequent strapping process. The controller 800, responsive to the strap S being over tensioned (i.e., the amount of tension in the strap loop being above the designated tension range), adjusts the tensioning parameter of the tensioning module to decrease the tension pulled by the tensioning module for the subsequent strapping process. The controller 800 thus determines how to and then makes any adjustments to the tensioning parameter for subsequent strapping of loads. The controller 800 also controls the movement of the load L from under the platen 300 and as the load L moves out of the strapping device 10.

The controller 800 can repeat this process of determining and making any adjustments to the tensioning module for subsequent strapping of loads.

In various embodiments, the tension-measurement system 700 is electronically controlled and does not require the operator to manually make any adjustments to any components of the strapping device.

In various embodiments, the strapping device 10 automatically detects the tension quality during strapping of loads and makes the necessary adjustments without operator input. This better ensures that the tension of the straps applied by the strapping device 10 are within the acceptable ranges and provide more consistently proper strapped loads. In various embodiments, the strapping device 10 prevents the tensions on the straps from getting substantially outside or inside of the optimal tension range.

In various embodiments, the strapping device 10 can be configured to alert an operator if the strapping device detects a strap that is outside or substantially outside of the optimal tension range for checking of straps that have the potential of breaking and for possible re-strapping.

In various other embodiments, the tension-measurement system is not connected to the platen 310. Rather, the strap engager, the strap-engager actuator, and the force sensor are connected to a separate component of the strapping device, but still function in the manners described above.

The tension-measurement system of the present disclosure thus solves the above problems.

The invention claimed is:

1. A strapping device comprising:

a movable platen configured to apply a compressive force to a load to compress the load before strapping;

a strapping head configured to carry out a strapping process to form a loop of strap around the load, the strapping process including a tensioning cycle during which the strapping head is configured to tension the strap at least in part based on a tension parameter;

a strap engager supported by the platen, the strap engager movable between a strapping position adjacent to the load and a measurement position spaced from the load;

a force sensor supported by the platen and configured to detect an amount of force; and a controller configured to:

control the strapping head to carry out the strapping process to form the loop of strap around the load;

after forming the loop of strap around the load, receive, from the force sensor, force data representing an amount of tension in the loop of strap;

determine, based on the force data, whether a tension-adjustment condition is met; and responsive to determining that the tension-adjustment condition is met, automatically adjust the tension parameter for a later tensioning cycle.

2. The strapping device of claim 1, wherein the strap engager comprises a finger, wherein the controller is operably connected to the strap engager to move the strap engager from the strapping position to the measurement position, wherein the controller is configured to control the strapping head to carry out the strapping process to form the loop of strap around the load with the strap engager in the strapping position such that the finger of the strap engager is between the load and the loop of strap, wherein the controller is configured to move the strap engager from the strapping position to the measurement position after forming the loop of strap around the load and to receive the force data after the strap engager reaches the measurement position.

3. The strapping device of claim 2, wherein the force data represents the amount of force sensed by the force sensor when the strap engager is in the measurement position.

4. The strapping device of claim 3, wherein the force data represents the amount of force applied by the finger of the strap engager to the loop of strap when the strap engager is in the measurement position.

5. The strapping device of claim 3, further comprising a strap-engager actuator operably connected to the strap engager and configured to move the strap engager from the strapping position to the measurement position, wherein the force data represents the amount of torque exerted by the strap-engager actuator when the strap engager is in the measurement position.

6. The strapping device of claim 1, wherein the controller is configured to determine the amount of tension in the loop of strap based on the force data and to determine whether the tension-adjustment condition is met by determining whether the amount of tension in the loop of strap is within a designated tension range.

7. The strapping device of claim 6, wherein the tension parameter comprises a tension level, wherein the controller is configured to, responsive to determining that the tension-adjustment condition is met:

responsive to determining that the amount of tension in the loop of strap is below the designated tension range, increase the tension level for a next strapping process; and responsive to determining that the amount of tension in the loop of strap is above the designated tension range, decrease the tension level for a next strapping process.

8. The strapping device of claim 1, wherein the controller is configured to determine that the tension-adjustment condition is met when the loop of strap is over-tensioned or under-tensioned.

9. The strapping device of claim 1, wherein the controller is configured to:

control the platen to descend such that the platen compresses the load before controlling the strapping head to carry out the strapping process; and control the platen to ascend after forming the loop of strap around the load and before receiving the force data.

10. The strapping device of claim 1, wherein the strap engager comprises a finger, and wherein the controller is configured to cause the strap-engager to pull the loop of strap a predetermined distance away from the load to determine the force data representing the amount of tension in the loop of strap.

11. A method of operating a strapping machine, the method comprising:

moving a platen to compress a load;

carrying out a strapping cycle to form a loop of strap around the load and around a part of a movable strap engager supported by the platen, the strapping cycle including a tensioning cycle during which the strap is tensioned around the load at least in part based on a tension parameter;

after the loop of strap has been formed around the load, receiving, from a force sensor supported by the platen, force data representing an amount of tension in the loop of strap;

determining, based on the force data, that a tension-adjustment condition is met; and responsive to determining that the tension-adjustment condition is met, automatically adjusting the tension parameter for a later tensioning cycle.

12. The method of claim 11, further comprising:

carrying out the strapping process to form the loop of strap around the load with the strap engager in a strapping position such that a finger of the strap engager is between the load and the loop of strap, wherein the finger comprises the part of the strap engager;

moving the strap engager from the strapping position to a measurement position after the loop of strap is formed around the load; and receiving the force data after the strap engager reaches the measurement position.

13. The method of claim 12, wherein the force data represents the amount of force sensed by the force sensor when the strap engager is in the measurement position.

14. The method of claim 13, wherein the force data represents the amount of force applied by the finger of the strap engager to the loop of strap when the strap engager is in the measurement position.

15. The method of claim 13, further comprising moving the strap engager from the strapping position to the measurement position via a strap-engager actuator operably connected to the strap engager, wherein the force data represents the amount of torque exerted by the strap-engager actuator when the strap engager is in the measurement position.

16. The method of claim 11, further comprising determining the amount of tension in the loop of strap based on the force data and determining that the tension-adjustment condition is met by determining that the amount of tension in the loop of strap is within a designated tension range.

17. The method of claim 16, wherein the tension parameter comprises a tension level, further comprising, responsive to determining that the tension-adjustment condition is met and that the amount of tension in the loop of strap is below the designated tension range, increasing the tension level for a next strapping process.

18. The method of claim 17, further comprising, responsive to determining that the tension-adjustment condition is met and that the amount of tension in the loop of strap is above the designated tension range, decreasing the tension level for a next strapping process.

19. The method of claim 11, further comprising determining that the tension-adjustment condition is met when the loop of strap is over-tensioned or under-tensioned.

20. The method of claim 11, further comprising causing the strap engager to move such that a finger of the strap engager pulls the loop of strap a predetermined distance away from the load to determine the force data, wherein the finger comprises the part of the strap engager.

* * * * *